United States Patent [19]

Weiner et al.

[11] Patent Number: 4,720,237

[45] Date of Patent: Jan. 19, 1988

[54] UNISON RING ACTUATOR ASSEMBLY

[75] Inventors: Harvey I. Weiner, South Windsor; Alexander Kurti, West Hartford, both of Conn.

[73] Assignee: United Technologies Corporation, Hartford, Conn.

[21] Appl. No.: 832,553

[22] Filed: Feb. 24, 1986

[51] Int. Cl.[4] ..... F01D 17/16

[52] U.S. Cl. ..... 415/150; 415/160; 92/161

[58] Field of Search ..... 415/149 R, 150, 151, 415/155, 159, 160; 92/161; 248/672, 674; 74/471 R, 89; 60/39.23

[56] References Cited

U.S. PATENT DOCUMENTS

| | | | |
|---|---|---|---|
| 1,375,843 | 4/1921 | Hilton | 92/161 X |
| 3,297,307 | 1/1967 | Jahns | 415/160 |
| 3,487,992 | 1/1970 | Pineda | 415/149 R |
| 3,574,479 | 4/1971 | Barnard | 415/160 |
| 3,801,216 | 4/1974 | Holzhauer et al. | 415/160 X |
| 3,873,230 | 3/1975 | Norris et al. | 415/149 R X |
| 4,373,859 | 2/1983 | Thebert | 415/159 |
| 4,403,912 | 9/1983 | Pekari et al. | 415/150 |

*Primary Examiner*—Robert E. Garrett
*Assistant Examiner*—Joseph M. Pitko
*Attorney, Agent, or Firm*—Troxell K. Snyder

[57] ABSTRACT

An actuator assembly for imparting non-proportional tangential displacement (**22*b*) to a plurality of unison rings (16*b*, 16*c*) disposed about the exterior of a compressor case (10*b*) is provided. The assembly includes a linear drive component (26*b*) mounted on trunnions (74, 76) and supported by a frame 48. The drive component (26*b*) imparts a rotating motion to a crankshaft 70 which in turn drives the unison rings (16*b*, 16*c*) via the respective crank arms (42*b*, 42*c*) and pushrod (30*b*, 30*c*) linkages. Radial loading of the compressor case (10*b*) is avoided by aligning both the pushrod (30*b*) and the elongated frame first end (50) tangential to the compressor case (10*b***).

8 Claims, 6 Drawing Figures

UNISON RING ACTUATOR ASSEMBLY

FIELD OF THE INVENTION

The present invention relates to an actuator assembly, and more particularly, to an actuator assembly for imparting a tangential displacement to a unison ring or the like.

BACKGROUND

Unison rings are provided on the axial compressor sections of modern gas turbine engines to allow adjustment of the compressor stator vane angle during operation of the engine. In simple terms, each stator vane in an individual compressor stage is provided with a mounting pivot disposed in the compressor housing and oriented so as to permit rotation of the stator vane about its longitudinal axis. Simultaneous movement of the vanes in an individual stage is accomplished through the use of a unison ring, disposed circumferentially about the exterior of the compressor housing and linked to each stator vane by individual vane lever arms which rotate each vane about its corresponding pivot in response to the tangential displacement or rotation of the unison ring.

Typical gas turbine engines utilize a plurality of compressor stages, each stage comprising a set of stator vanes for receiving and redirecting the air or gas issuing from the rotating blades of the preceding stage. For gas turbine engines operating at varying speeds and inlet conditions, such as those used in the aircraft industry, it is particularly beneficial to alter the angle of attack of the individual stage stator vanes depending upon the current engine operating speed and conditions.

Typical gas turbine engines thus include two or more stages of adjustable stator vanes, each having a corresponding unison ring. The unison rings are usually adjusted by a single actuator assembly, the actuator assembly displacing the individual unison rings tangentially in response to engine speed, power requirement, or other operating parameters in order to achieve dependable and efficient operation. As typical unison ring operation schedules call for simultaneous movement of the individual unison rings in response to the selected parameter or parameters, it is therefore common to utilize a single drive component to initiate the displacement of the individual unison rings. This drive component, such as a linear hydraulic piston actuator, is mounted to the exterior of the compressor housing and acts against the drive arm of a bellcrank which is also mounted to the compressor housing and rotatable about an axis parallel to the longitudinal axis of the compressor. A plurality of pushrods connect the individual unison rings to corresponding crank arms on the rotatable bellcrank, thus moving the rings in response to the rotation of the bellcrank under the influence of the linear drive component. A typical actuation system according to the prior art is disclosed in U.S. Pat. No. 4,403,912 "Integrated Multiplane Actuator System for Compressor Variable Vanes and Air Bleed Valve".

As would be expected with actuator systems supported about the periphery of a compressor housing or the like, the transfer of loads to the housing is of particular concern, with care being taken to avoid the imposition of excessive radial forces which may deform the lightweight housing. As would be readily appreciated by those familiar with axial gas compressors, the clearance between the rotating compressor blades and the generally cylindrical compressor housing must be minimized in order to achieve acceptable compressor operating efficiency. Such clearance may be reduced or otherwise compromised by local deformation of the compressor housing either inwardly or outwardly as the result of local radial or bending forces imparted to the compressor housing by the unison ring actuator.

In the past, the loading of the compressor housing has been addressed primarily through the use of local bracing and other well known methods of distribution the imposed stress. This approach, while successful and still currently in use, has added components, complexity, and weight to the final assembly.

It has further been found that such engines profit by the non-proportional movement of the individual stator vanes. The achievement of such non-proportional actuation between the individual stator stages has required engine designers to provide an increased radial displacement between the compressor housing and the bellcrank pivot, further increasing the bending stress on the bellcrank mountings and likewise on the compressor housing. The concurrent increase in size of the drive component has likewise increased its radial displacement relative to the compressor housing thus multiplying the loads imposed on the drive component mounting brackets.

In addition, deflections of the compressor case and bellcrank mounting affect the accuracy of the actuation system, a distinct disadvantage when even a few degrees of vane angle error may significantly reduce compressor efficiency. Such accuracy may also be influenced by the differential thermal expansion of the various components as the engine is heated and cooled throughout the operating cycle.

What is required is an actuator for imparting non-proportional tangential displacement to a plurality of compressor unison rings which does not impose undesirable radial forces or local bending moments upon the compressor housing, and which minimizes positional inaccuracy of the individual stator vane stages due to component deflection under load or differential thermal expansion.

SUMMARY OF THE INVENTION

In accordance with the present invention, an actuator assembly is provided for selectively imparting a tangential displacement to a plurality of unison rings located about the circumference of an axial compressor or other generally cylindrical body. The assembly is secured to the compressor housing at circumferentially spaced-apart locations, and includes a linear drive component and a bellcrank or crankshaft cooperatively engaged and secured within a single frame.

The frame is configured and secured to the housing so as to minimize the radial forces imparted to the housing during operation of the actuator assembly as compared to prior art systems, thereby reducing distortion of the compressor housing and the likelihood of incurring housing-blade interference. The assembly according to the present invention further provides that the frame is subject mainly to only tension loading, thus allowing the use of a simple, lightweight frame in accordance with the preferred embodiment of the present invention.

The present invention further provides for mounting the crankshaft sufficiently radially outward of the compressor housing so as to permit the unison ring crank arms to move adjacent the compressor housing, reducing the radial force component of the ring drive pushrods against the individual unison rings, the crankshaft mounting further facilitating the non-proportional tangential displacement between individual unison rings. In the preferred embodiment of the present invention, the linear actuator is pivotably mounted on trunnions in a frame member comprised of a pair of spaced-apart plates, thus avoiding the creation of an internal bending moment within the frame.

It is therefore an object of the present invention to provide an assembly for selectively imparting tangential displacement to a plurality of unison rings disposed about the circumference of a generally cylindrical axial compressor or the like.

It is further an object according to the present invention to impart such tangential displacement while minimizing the imposition of radial or bending loads on the compressor housing.

It is still further an object of the present invention to provide a supporting framework for the actuator assembly which is mainly loaded only in tension.

It is still further an object of the present invention to provide an actuator assembly which is substantially removable from the compressor housing as a single unit.

It is still further an object of the present invention to provide an actuator assembly which avoids positional inaccuracies caused either by differential thermal expansion between the actuator components and the compressor case or by load deflection of the case or actuator support members.

GENERAL DISCUSSION OF VANE ACTUATION SYSTEMS

Figure 1:
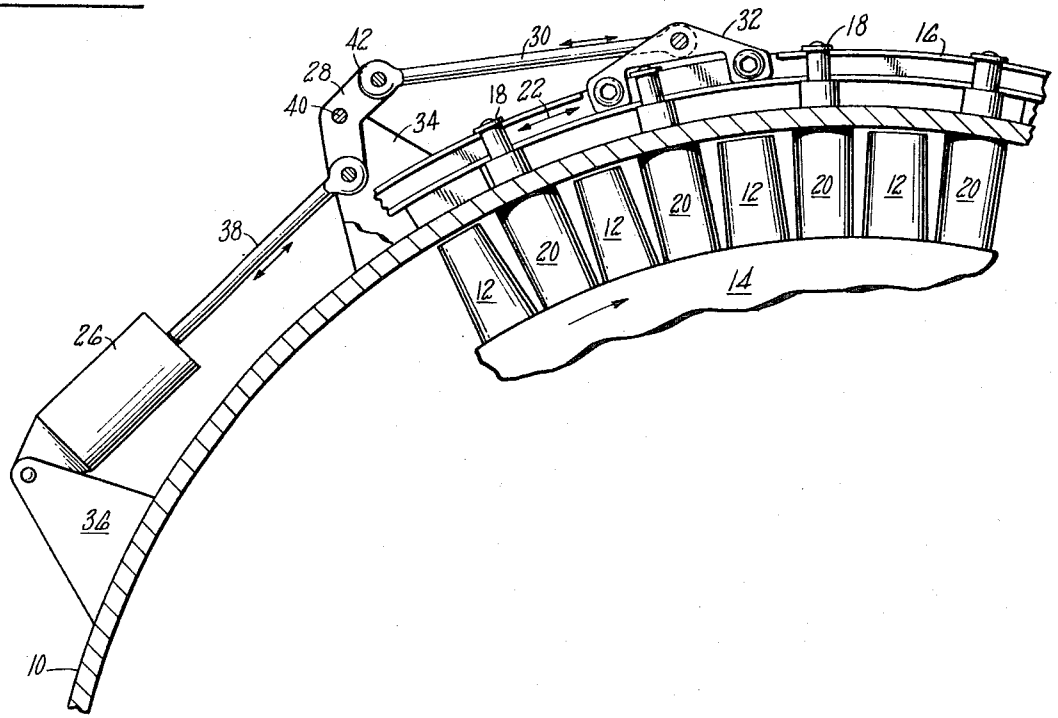
FIG. 1 PRIOR ART
FIG. 1 shows a prior art actuator mounting system used in gas turbine engines.

Before detailing the preferred embodiment of the vane actuation system according to the present invention, a more complete discussion of the operating environment and prior art solutions heretofore applied to the problem of unison ring movement will be examined and discussed with reference to the appended drawing figures. With particular reference to FIG. 1, a prior art proportional vane actuation system will be discussed in detail.

FIG. 1 shows a cross sectional view of a compressor case 10 surrounding a plurality of moving compressor blades 12 secured to a compressor disk 14 at their radially inner ends. This single rotating assembly represents a portion of one stage of a multi-stage axial compressor, the configuration and operation of which is well known to those skilled in the compressor art.

As will be appreciated by those skilled in the art, the relationship between the stator vanes and the rotating compressor blades is a cooperative one, with overall compressor efficiency being related to the optimization of the direction of flow of the air impacting the rotating blades. As is also well known, the magnitude of this optimum angle varies according to the rotational speed of the compressor blades, temperature and pressure of the gas entering the corresponding compressor stage, the volumetric flow rate of the gas undergoing compression, and a variety of other parameters having different degrees of impact.

Gas turbine engines utilized by the air transport industry are called upon to operate under a wide variety of circumstances, including altitude, temperature, load, weather conditions, etc. Such engines, unlike their stationary counterparts used for generating a constant output of power for an optimized industrial process or the like, must operate reliably and efficiently under all such conditions and respond automatically to any significant change therein.

As far as the axial compressor section of such engines is concerned, one method of effectively adjusting engine operation to meet differing inlet, speed, and other operating conditions is to adjust the angle of the stator vanes in one or more of the individual stages of the compressor section. Such adjustment is typically performed simultaneously for all of the vanes of a particular compressor stage through the use of a unison ring 16 which surrounds the generally cylindrical compressor case 10 as shown in FIG. 1.

Figure 2:
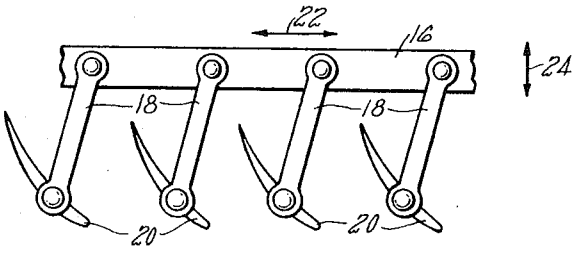
FIG. 2 shows an arrangement of an individual unison ring and a plurality of adjustable stator vanes.

While not of direct impact with regard to the operation of the present invention, the unison ring 16 affects the alteration of the rotational position of the stator vanes of an individual compressor stage by means of a plurality of vane arms 18 each shown in FIG. 2 as being secured at one end to the radially outward end of the pivotal stator vanes 20. The other end of each vane arm 18 is pinned to the unison ring 16, thus causing simultaneous rotational movement of the individual stator vanes 20 in response to the tangential displacement 22 of the ring 16. As will be appreciated from observing FIG. 2, the unison ring 16 also experiences a much smaller axial displacement 24 which is typically of no consequence to the operation of the unison ring and the still to be discussed actuator system.

The adjustment of the angle of a stage of compressor inlet vanes is typically initiated through the use of an actuator system which includes a mechanical or hydraulic drive component responsive to a control signal or other parameter generated by the overall engine control system. One such prior art actuation system is shown schematically in FIG. 1, comprising a linear actuator 26 acting on one arm of a bellcrank 28. The other arm of the bellcrank 28 engages a push rod 30 which links it to a clevis connection 32 secured to the unison ring 16. The bellcrank 28 is pivotally mounted on a bellcrank support 34 secured to the compressor case 10. The linear drive component 26 is likewise mounted to a support 36.

During operation of the prior art actuation system of FIG. 1, the linear drive component 26 extends a drive rod 38, imparting a rotational motion to the bellcrank 28. The rotational motion of the bellcrank 28 is translated into a tangential displacement 22 of the unison ring 16 through the pushrod linkage 30. As will be more clearly explained hereinbelow, the relationship between the linear displacement of the drive rod 38 under the influence of the linear drive component 26 is related to the tangential displacement 22 of the unison ring 16 by the geometry of the bellcrank 28.

The actuation system as shown in FIG. 1 is thus able to impart the desired tangential displacement 22 to the unison ring 16. For those axial compressors having multiple stages, each with adjustable stator vanes, the actuation system as shown in FIG. 1 may be expanded by adding additional crank arms to the bellcrank 28, each being linked to unison rings corresponding to the individual compressor states. A typical multi-stage compressor unit may have four or more adjustable stages of stator vanes actuated by a system driven from a single drive component 26.

As will be appreciated by those skilled in the art, the force exerted by the bellcrank and linear drive component is related to the size of the individual compressor stage as well as the number of stages being controlled by a given actuator system. For modern engines having many adjustable stages of stator vanes, the total tangential force exerted on the unison rings may be as high as 5,000 pounds or more. It should be apparent that the reactive force experienced by the bellcrank and drive component supports 34, 36 in such situations will result in the imposition of a relatively large local bending moment at the point of attachment of each support to the compressor case 10.

The design of the compressor housing is typically a balance between the strength required to support and otherwise contain the compressor internals and gas and the desired to minimize the overall weight of the compressor and thus the gas turbine engine. As will be appreciated, the local imposition of a significant bending moment, conceptually and physically translatable into a pair of opposing, circumferentially spaced-apart radial forces, may slightly deform the compressor case which is otherwise of sufficient strength. The consequences of such local deformation may be more fully appreciated by noting that the efficiency of an axial compressor is also related to the quality of the sealing which occurs between the rotating blades 12 and the compressor case 10 for each individual compressor stage. The effectiveness and quality of such sealing is adversely affected by any deviation of the compressor case interior from a perfect circle, allowing gas to leak backward through the compressor at those points wherein case-blade clearance is unduly large, and causing case-blade interference at those points wherein the clearance is too small or non-existent. The avoidance of high local bending moments or other radial loads is thus of great interest to the designers and manufacturers of axial compressors, and in particular to those in the aircraft powerplant industry.

One technique to reduce the local bending stress on the compressor case 10 is to reduce the radial displacement between the bellcrank pivot point 40 and the other diameter of the compressor case 10 as in the FIG. 1 assembly by configuring the crank arms 42 to extend generally radially outward with respect to the compressor housing. This approach has been useful in actuation systems of the prior art wherein the outer diameter of the compressor case has been limited in size and wherein the individual stator vane stages have moved in a proportional fashion, i.e., each stage at any given time is positioned at a fraction of its full design angular displacement which is equivalent to that of each of the other individual stator vane stages.

The recent evolution of compressor and gas turbine engine design which provides compressors of larger outer diameter and requiring non-proportional displacement of individual stator vane stages has reduced the attractiveness of the actuator arrangement as shown in FIG. 1.

Non-Proportional Control

The search for ever-increasing gas turbine engine efficiency has prompted designers to specify non-proportional adjustment of individual compressor vane stages, particularly for those compressors associated with modern gas turbine engines. In a non-proportional stator vane control system, individual stages of stator vanes are no longer moved simultaneously the same portion of their full range, but are instead scheduled to move at varying fractions of their total operational range resulting, for example, in certain stages being essentially stationary during the adjustment of other stages, and vice versa.

This non-proportional adjustment is accomplished by the non-proportional tangential displacement of the individual unison rings 16 in a multiple stage axial compressor. This non-proportional tangential displacement is accomplished by specifying the proper initial radial orientation of the crank arm 42 on the bellcrank 28 for the corresponding unison ring 16 such that the rotation of the bellcrank 28 will result in the appropriate movement of the ring 16. In this fashion, the tangential displacement, $\Delta Y$, of an individual unison ring in response to a small angular displacement, $\Delta\theta$, of the bellcrank 28 is approximated by the relation:

$$\Delta Y = R \cos \theta_1 - R \cos (\theta_1 + \Delta\theta)$$

wherein

R is the radius of the crank arm 42, and $\theta_1$ is the initial angular displacement of the crank arm 42 with respect to a reference line parallel to a tangent to the unison ring 16 at the clevis 32.

Such non-proportional displacement between individual unison rings may be accomplished to a certain extent with the FIG. 1 assembly by modification of the bellcrank 28. This configuration has not proved suitable for use in the newer compressors now being developed for the air transport industry due to the limited range of initial angular displacement achievable in a given arrangement. For engines having large diameter compressors, the long length of pushrod 30 required to avoid imposing an undesirably high radial force on the drive clevis 32 and unison ring 16 can require additional stiffening in the pushrod 30 to prevent the occurrence of compressive buckling.

Figure 3:
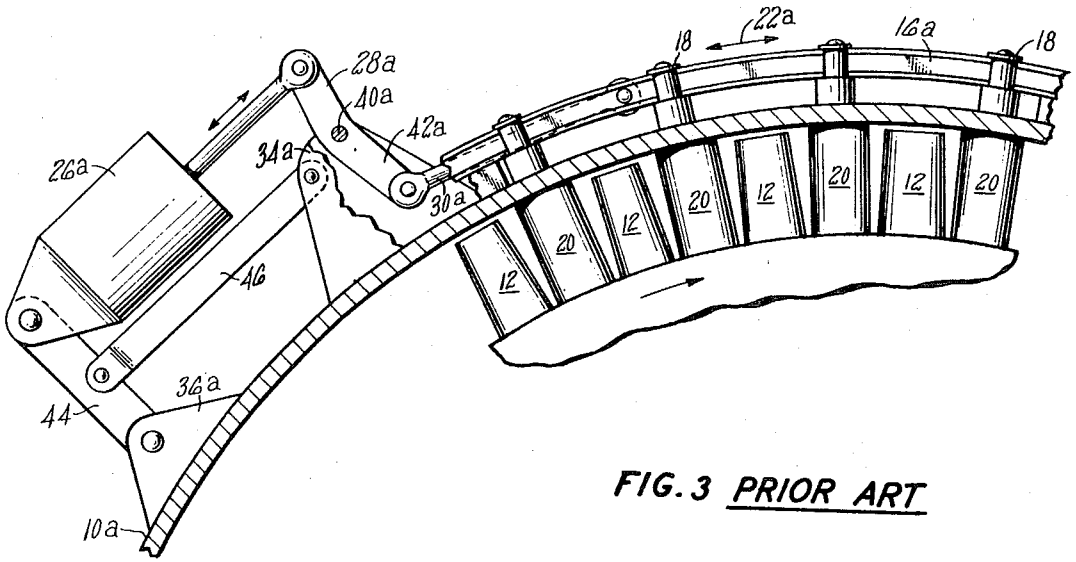
FIG. 3 PRIOR ART
FIG. 3 shows a prior art actuator for providing non-proportional adjustment in gas turbine engines.

These considerations have led to the prior art actuator assembly shown in FIG. 3, wherein the crank arm 42*a* swings between the bellcrank pivot 40*a* and the larger compressor case 10*a*. Pushrod 30*a* is thus more easily aligned for substantially exerting only a tangential force on the unison ring 16*a* throughout its movement range 22*a*. The radially inward extension of the crank arm 42*a* with respect to the compressor housing 10*a* has resulted in the increased outward radial displacement of the bellcrank shaft 40*a* from the housing 10*a* as compared to the FIG. 1 assembly.

In order to avoid imparting a bending moment to the compressor case 10*a* by the drive component 26*a*, the design of FIG. 3 utilizes a pivoted drive component support arm 44 hinged both at the point of contact with the drive component support 36*a* and the drive component 26*a*. A rigid support link 46 connecting the support arm 44 and the bellcrank support 34*a* serves to lock the actuator support structure against movement.

Although effective in the particular application for which it was designed, the system of FIG. 3 has a number of areas in which improvement could be made. For example, the use of a pivoting connection between the support arm 44 and the drive component support 36a, while reducing the magnitude of the bending moment imposed on the compressor case 10a locally, required the use of at least two additional members 44, 46 to provide the required structural rigidity. In addition, the removal of the bending stress imposed by the support 36a did not eliminate moment forces imparted to the case 10a by the bellcrank support 34a, especially when considered in view of the increased radial displacement between the bellcrank pivot 40a and the compressor case necessitated by the inwardly disposed crank arms 42a.

Finally, it is evident that the support arm 44 is subject to significant bending stresses during the operation of this assembly. The need for the support 44 to withstand these forces requires a stronger and heavier member.

Although not directly related to the operation of the actuator system as shown in FIG. 3, it will be appreciated for a manufacturing standpoint that the large number of individual components in the FIG. 3 assembly must be machined within very close tolerances in order to avoid an undesirably large displacement error in the final assembled actuator. The need for close dimensional tolerances in each of the actuator structural members, as well as the labor cost involved in assembling the prior art actuator in place on the compressor case 10a have increased the cost of the actuator system.

DETAILED DESCRIPTION OF THE PREFERRED EMBODIMENT

Figure 4:
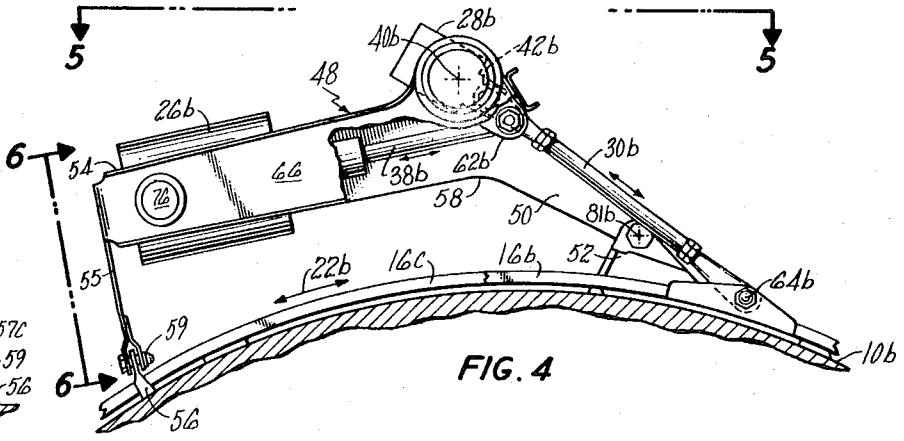
FIG. 4 shows a view of the actuator assembly according to the present invention in the axial direction.

FIG. 4 shows an actuator assembly according to the present invention wherein a single frame member 48 supports both the bellcrank 28b and the linear drive component 26b. The frame 48 is secured to the compressor case 10b at each end as shown in FIG. 4, the first end 50 being pinned 81b to a frame support 52, and the second end 54 supported by a web 55 which is slidably secured 59 to the compressor case 10b at a second end support 56. The use of a pin connection between the first end 50 and the frame support 52 insures that no significant bending moment may be applied to the compressor case 10b by the frame 48. Likewise, the use of a substantially circumferential sliding joint 59, 56 does not permit the transfer of tangential or bending forces between the frame 48 and the compressor case 10b. It is preferable (see FIG. 4) to orient the slide joint 59, 56 along a line passing through the first end pin connection 81b to minimize the occurrence of error in the positioning of the unison ring 16b as a result of the occurrence of differential thermal expansion between the actuator system and the compressor case 10b.

The frame 48 also includes a central portion 58, forming a bridge between the first end 50 and the second end 54 and supporting a bearing 60 (not shown in FIG. 4) for supporting the bellcrank 28b. Crank arm 42b of the bellcrank is connected to the pushrod 30b which is itself in turn linked to the unison ring 16b as shown in FIG. 4. Bellcrank 28b also includes a drive arm 62b which is linked to the linear drive actuator rod 38b. It is a particular feature of the actuator system according to the present invention that the location of the frame support 52 is proximate the point of connection 64b between the pushrod 30b and the unison ring 16b.

The features and advantages of the actuator system according to the present invention should now be readily apparent. Force exerted on the unison ring 16b by the pushrod 30b creates an opposing resultant force acting on the frame member 48. As this resultant force is substantially tangential to the compressor case 10b at the pushrod connecting point 64b, and as this reactive force acts substantially along a line passing through the point of connection 81b between the frame first end 50 and the frame support 52, the main force imposed by the frame 48 on the compressor case 10b is a tangential force at the point of connection between the frame support 52 and the case 10b. The force exerted by the linear drive component 26b against the drive arm 62b of the bellcrank 28b is wholly contained within the frame 48 and is not imposed on the compressor case 10b.

It is apparent that the substantially perfect alignment shown between the pushrod 30b and the pin connection between the first end 50 and the frame support 52 cannot be maintained throughout the operating stroke 22b of the actuator. There will be some slight deviation from the perfect force balance as the actuator ring 16b is tangentially translated by the actuator. This slight misalignment results in the imposition of a small moment on the frame 48 which is counterbalanced by a very small radial force acting against the compressor case 10b through the second end support 56. One application of an actuator system according to the present invention has been calculated to exert a radial force at the second end support 56 which is just 4% of the total tangential force exerted by the actuator against all the unison rings combined.

It will also be apparent from FIG. 4 that actuation of the unison ring 16b in a clockwise, vane opening direction results in the imposition of essentially tensile forces on the ends 50, 54 of the frame member 48. As the vane actuation loading is typically higher in the opening direction as compared to the reverse, the actuator arrangement according to the present invention reduces the required frame structural strength and weight. The configuration of the actuator system according to the present invention allows the bellcrank pivot point 40b to be radially outwardly spaced apart from the compressor case 10b, thus permitting greater flexibility in the specification of the crank arm radii and initial starting positions.

Figure 5:
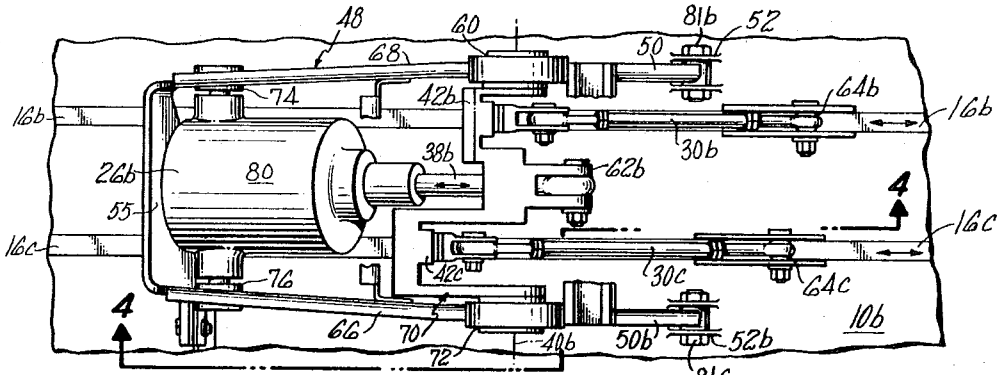
FIG. 5 shows a radial view of the actuator according to the present invention.

Turning to FIG. 5, the preferred embodiment of the actuator system according to the present invention may be seen as including a frame 48 comprised of two stiffened plate members 66, 68 of subsantially similar configuration, each being secured to the compressor case 10b at their first ends 50, 50b to frame supports 52, 52b, and being axially spaced apart with respect to the central axis of the compressor. Plate stiffening is accomplished by channeling or otherwise augmenting plate rigidity.

In this configuration, the bellcrank 28b is more clearly termed and shown as a crankshaft 70 supported between bearings 60, 72 disposed in the individual respective plate members 68, 66. Pushrods 30b and 30c each drive respective unison rings 16b, 16c as a result of the rotation of the crankshaft 70 and the corresponding crank arms 42b, 42c.

The linear drive component 26b is shown as having a mounting case 80 pivotably supported by trunnions 74, 76 disposed in the respective plate members 68, 66. The trunnions 74, 76 include spherical bearings ensuring that the mounting case 80 is unable to directly exert any bending moment to the frame.

Figure 6:
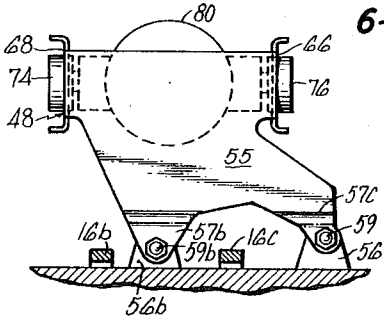
FIG. 6 is a circumferential view as indicated in FIG. 4.

FIG. 6 shows a circumferential view of the preferred embodiment actuator wherein the web 55 includes support lugs 57b, 57c secured to respective second end supports 56b, 56 by slide pins 59b, 59. The use of two axially spaced second end supports 59b, 59 provides the frame 48 with increased resistance to distortion caused by assymetric loading of the crankshaft 70 or drive component trunions 74, 76. Due to spacing limitations, the support lugs 57b, 57 are skewed axially for attachment to the case 10b intermediate the unison rings 16b, 16c. As disclosed hereinabove, the axes of the slide pins 59b, 59, are preferably aligned colinearly with the first end pin connections 81b, 81c to limit vane placement error resulting from differential thermal expansion between the actuator system and the compressor case 10b.

An alternative to the sliding second end support is the use of support lugs 57b, 57c which are flexible in the circumferential direction but relatively rigid in the axial and radial directions. This alternative means (not shown) for supporting the second end 54 of the frame 48 is fixedly secured to the compressor case 10b, accommodating any relative circumferential displacement between the actuator assembly and the compressor case by bending circumferentially. Although not preferable due to the occurrence of bending stresses in the lugs 57b, 57c, this alternate support arrangement may be useful for certain applications.

In terms of manufacturing, assembly, and subsequent service, the actuator assembly according to the present invention supersedes those configurations known in the prior art in a number of significant ways. First of all, the combination of the drive component 26b and bellcrank 28b into a single frame unit 48 allows a significant portion of the actuator assembly to take place independent of the compressor casing. In this fashion, the frame 48, crankshaft 70, drive component 26b and pushrods 30b, 30c, may be preassembled before the entire unit is secured to the frame supports 52, 56 leaving only the remaining free ends of the pushrods 30b, 30c to be connected to the corresponding unison rings 16b, 16c. The simplicity of attachment and subsequent removal of the actuator assembly according to the present invention reduces both the amount of time and skilled labor required to service both the compressor and the actuator assembly.

Secondly, the combining of three critically positioned loci (the first end pin connection points 81b, 81c, the crankshaft support bearings 60, 72, and the drive component trunnions 74, 76) in a single member 48 significantly reduces the manufacturing tolerances required to result in an acceptable overall assembly construction. The accuracy of operation of the system according to the present invention is thus more independent of the relative dimensional variation of the compressor case 10b which occurs due to differential thermal expansion.

The actuator system according to the present invention is thus well adapted to provide a simple, lightweight assembly for imparting the desired tangential displacement to a plurality of unison rings disposed circumferentially about a compressor case or the like. It should be appreciated that the crankshaft 70, shown in FIG. 5 as moving only two crank arms 42b, 42c, is equally well suited for effectively supporting and moving four or more such crank arms and a like number of corresponding pushrods and unison rings.

It will further be appreciated that although every effort has been made to disclose all the features and advantages of the present invention with particular reference to the preferred embodiment thereof, it is certain that there are additional features, advantages, and equivalent embodiments within the scope of the present invention which will become apparent to those skilled in the art upon a thorough review of the foregoing specification and the appended claims and drawing figures.

What is claimed is:

1. An actuator for selectively imparting a tangential displacement to first and second unison rings each disposed closely about respective first and second cylindrical portions of an axial compressor housing or the like, comprising:

frame member having a first plate with a first end, a second end, and a central portion therebetween, the first end being secured at a first point to the housing against radial, axial, or tangential movement therebetween, the second end being secured to the compressor housing at a second point circumferentially displaced about the housing from the first point against radial and axial movement with respect to the compressor housing, the central portion forming a bridge between the first and second ends, and a bearing, disposed in the central portion;

a crankshaft, supported by the bearing and rotatable about an axis parallel to the longitudinal axis of the compressor cylindrical portions, the crankshaft and bearing being radially outwardly displaced from the unison rings;

a drive arm, secured to the crankshaft and extending radially outwardly therefrom;

a linear drive component, pivotably secured to the frame and coopertively engaged with the drive arm for imparting a selected rotational displacement to the crankshaft;

a first crank arm, secured to the crankshaft and rotatable therewith in the plane of the first unison ring;

a second crank arm, secured to the crankshaft and rotatable therewith in the plane of the second unison ring;

a first pushrod, disposed between the first crank arm and the first unison ring for imparting tangential displacement to the first unison ring in response to the rotational displacement of the crankshaft and first crank arm; and a second pushrod, disposed between the second crank arm and the second unison ring for imparting tangential displacement to the second unison ring in response to the rotational displacement of the crankshaft and second crank arm.

2. The actuator as recited in claim 1, wherein the frame member further comprises:

a second plate of substantially similar configuration to the first plate and similarly secured to the compressor housing at an axially spaced apart location, and wherein the first and second plates cooperatively support the crankshaft and the linear actuator.

3. The actuator as recited in claim 2, wherein the linear drive component includes a mounting case, supported between the first and second plates by respective first and second trunnions, and a drive rod, selectably linearly extensible from the mounting case, the rod further being in cooperative engagement with the drive arm for imparting the rotational displacement to the crankshaft.

4. The actuator as recited in claim 3, wherein the first and second trunnions each respectively include first and second spherical bearings for preventing the transfer of a bending moment between the frame member and the mounting case.

5. The actuator as recited in claim 1, wherein the linear drive component includes a mounting case, supported by the frame, and a drive rod, selectably linearly extensible from the mounting case, the rod further being in cooperative engagement with the drive arm for imparting the rotational displacement to the crankshaft.

6. The actuator as recited in claim 1, wherein the crank arms extend generally radially inwardly from the crankshaft with respect to the compressor housing.

7. The actuator as recited in claim 1, wherein the first and second crank arms each extend radially outwardly from the crankshaft at respective distinct first and second radial directions, thereby causing non-proportional tangential displacement between the first and second unison rings in response to the selected rotational displacement of the crankshaft.

8. The actuator as recited in claim 1, wherein the second end of the frame member and the compressor housing are secured by at least one slide pin oriented colinearly with the first securing point.

* * * * *